US007125326B2

(12) United States Patent
Walsh et al.

(10) Patent No.: US 7,125,326 B2
(45) Date of Patent: Oct. 24, 2006

(54) APPARATUS AND METHOD FOR REMOVING A CMP POLISHING PAD FROM A PLATEN

(75) Inventors: Cormac Walsh, Sunnyvale, CA (US); Jun Liu, Cupertino, CA (US); Gerard Moloney, Milpitas, CA (US); A. Ernesto Saldana, San Jose, CA (US)

(73) Assignee: Ebara Technologies Incorporated, Sacramento, CA (US)

( * ) Notice: Subject to any disclaimer, the term of this patent is extended or adjusted under 35 U.S.C. 154(b) by 0 days.

(21) Appl. No.: 11/160,197

(22) Filed: Jun. 13, 2005

(65) Prior Publication Data

US 2005/0277368 A1 Dec. 15, 2005

Related U.S. Application Data

(60) Provisional application No. 60/579,403, filed on Jun. 14, 2004.

(51) Int. Cl.
*B24D 11/00* (2006.01)

(52) U.S. Cl. ..... 451/442; 451/526; 451/539; 451/538

(58) Field of Classification Search ..... 451/442, 451/526, 539, 529, 531, 41

See application file for complete search history.

(56) References Cited

U.S. PATENT DOCUMENTS

| | | | | |
|---|---|---|---|---|
| 5,454,899 | A * | 10/1995 | Glenn et al. | 156/584 |
| 5,551,136 | A | 9/1996 | Bartlett | |
| 6,004,426 | A * | 12/1999 | Johnson | 156/344 |
| 6,221,199 | B1 | 4/2001 | Chang et al. | |
| 6,299,519 | B1 * | 10/2001 | Easter et al. | 451/526 |
| 6,600,000 | B1 * | 7/2003 | Oura et al. | 526/344 |

* cited by examiner

*Primary Examiner*—David B. Thomas
*Assistant Examiner*—Robert Scruggs
(74) *Attorney, Agent, or Firm*—Squire, Sanders & Dempsey L.L.P.

(57) ABSTRACT

The invention provides a pad removal apparatus and method that enables improved pad removal from a platen.

15 Claims, 3 Drawing Sheets

APPARATUS AND METHOD FOR REMOVING A CMP POLISHING PAD FROM A PLATEN

PRIORITY REFERENCE TO PRIOR APPLICATIONS

This application claims benefit of and incorporates by reference U.S. patent application Ser. No. 60/579,403, entitled "Polishing Pad Removal Tool for CMP," filed on Jun. 14, 2004, by inventors Gerard Moloney, Cormac Walsh, A. Ernesto Saldana and Jun Liu.

TECHNICAL FIELD

This invention relates generally to chemical mechanical polishing (CMP), and more particularly, but not exclusively, provides an apparatus and method for removing a pad from a platen.

BACKGROUND

CMP is a combination of chemical reaction and mechanical buffing. A conventional CMP system includes a polishing head with a retaining ring that holds and rotates a substrate (also referred to interchangeably as a wafer) against a polishing pad surface rotating in the same direction. The polishing pad can be made of cast and sliced polyurethane (or other polymers) with a filler or a urethane coated felt.

During rotation of the substrate against the polishing pad, a slurry of silica (and/or other abrasives) suspended in a mild etchant, such as potassium or ammonium hydroxide, is dispensed onto the polishing pad. The combination of chemical reaction from the slurry and mechanical buffing from the polishing pad removes vertical inconsistencies on the surface of the substrate, thereby forming an extremely flat surface.

After a pad is used, it must be removed from a platen on which it rests, which can be labor intensive and time consuming and can result in injury to an operator. The effort needed and the potential for injury is due to the high force required to overcome the attachment of the pad to the platen caused by a pressure sensitive adhesive disposed between the pad and platen. Further, the effort and potential for injury has increased as the industry has moved from 200 mm wafers to 300 mm wafer since the larger surface area of pads used increases the force required to remove them from platens.

Therefore, a new polishing pad removal apparatus and method are needed that overcome the above-mentioned shortcomings while substantially decreasing the amount of human effort required.

SUMMARY

Embodiments of the invention provide an apparatus and method of use thereof that enable the removal of pad from a platen. The apparatus and method require little human efforts, increase productivity and minimize possibility of injury to the operator.

In an embodiment of the invention, the method comprises: coupling a CMP pad to a rod; rotating the rod to roll up the pad; and sliding the rod laterally during the rotating.

In an embodiment of the invention, the apparatus comprises: a rod capable of being coupled to a CMP pad; and a motor coupled to the rod to cause rotation and sliding of the rod.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

The following description is provided to enable any person of ordinary skill in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1:
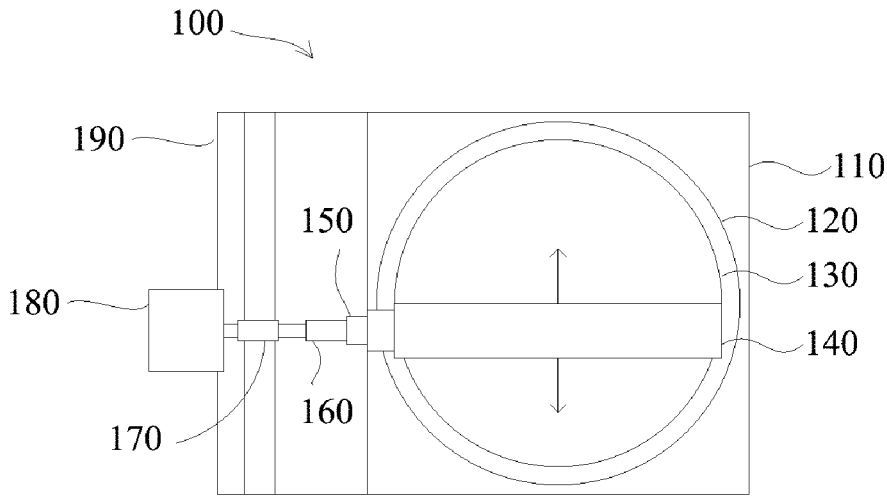
FIG. 1 is a diagram illustrating a top view of a chemical mechanical polishing apparatus according to an embodiment of the invention.

FIG. 1 is a diagram illustrating a top view of a chemical mechanical polishing apparatus 100 according to an embodiment of the invention. The apparatus 100 comprises a table 110 holding a platen 120 capable of rotational motion. Centered on the platen 120 is a pad 130 used for chemical mechanical polishing. Coupled to the table 110 is a guiding rail 190 to which a pad removal apparatus is coupled. The pad removal apparatus can be permanently or removeably coupled to the guiding rail 190. The pad removal apparatus comprises a rod 140 coupled at one end to an adapter 150, which is coupled to adjustable universal joints 160 and 170. The adaptor 150 connects the rod 140 and a motor 180 together to transfer the turning motion from the motor 180 to the rod 140. The joint 170 is in turn coupled to a motor 180, which is coupled to a guiding block 200, which is capable of lateral motion along the guiding rail 190.

The pad 130 can be of any type used for CMP. An example pad has a thickness of 50 Mils, a hardness of 70 Shore D, a density of 0.96 g/cc, and a tensile of 3500 psi. The pad 130 can be made of a porous polyurethane material and can have pores and/or grooves. The diameter of the pad can range from about 66 to about 81 centimeters in an embodiment.

The rod 140 has a length approximately equal to a diameter of the pad 130. However, in other embodiments of the invention, the rod 140 can be longer or shorter than the diameter of the pad 130. The rod 140, in an embodiment of the invention, has a diameter of about 1 to about 3 inches. A smaller diameter will tend to decrease pad removal time. In an embodiment of the invention, the rod 140 comprises two sections of different diameters. A first section has a length approximately equal to the diameter of the pad 130 has a first diameter while a second section extends has a shorter length and a smaller diameter than the first section. The motor 180 includes a low rpm (about 3 to about 20 rpm) gear motor so that torque delivered to the rod 140 can be converted to a pulling force to lift the pad 130 from the platen 120. In an embodiment of the invention, the motor 180 is bi-directional so that the pad 130 can be removed from any direction. A switch (not shown) can be used to switch the rotational motion of the motor 180. For safety purposes, the motor 180 can also include two start switches (not shown) so that both switches must be switched before the motor 180 activates.

As is known to those of ordinary skill in the art, the CMP apparatus 100 also includes a slurry dispensing mechanism to dispense a slurry (e.g., fumed silica) during CMP and a retaining apparatus for retaining a wafer (also referred to as a substrate) during CMP. The slurry dispensing mechanism and retaining apparatus are not shown so that the pad removal apparatus can be shown more clearly.

During operation of the pad removal apparatus, the rod 140 is positioned at an edge of the pad 130 and the pad 130 is then coupled to the rod 140, as will be discussed in further detail in conjunction with FIG. 2 below. The motor 180 is then activated causing rotation of the rod 140 and lateral motion of the rod 140. As rod 140 rotates and translates across the platen 120, the rod 140 removes and rolls up the pad 130 and the rod 140 also starts angling upwards due to the universal joints 160 and 170 and due to the collected width of the pad 130. The translation of the rod can be done using the motor 180 or via hand. After the pad 130 is completely removed from the platen 120, the pad removal apparatus can be detached from the table 110 and a new pad 130 installed onto the platen 120.

Figure 2:
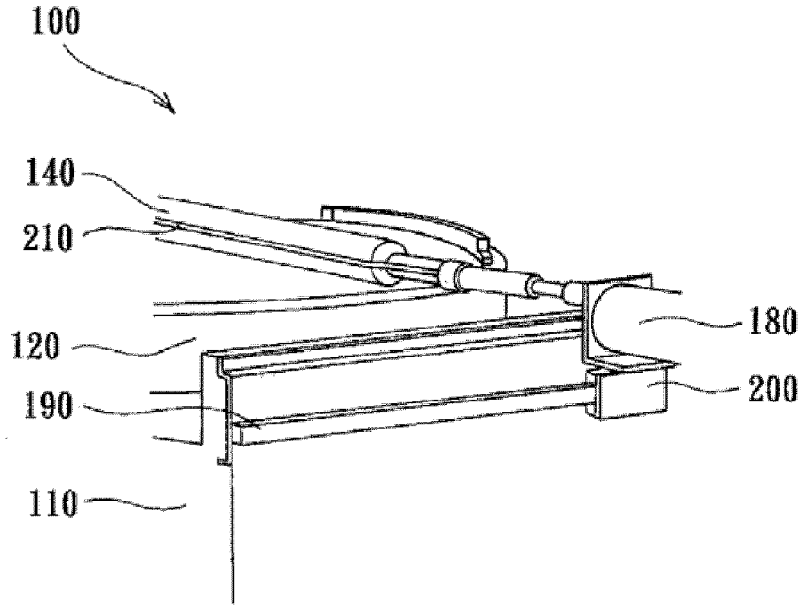
FIG. 2 is a diagram illustrating a first perspective view of the CMP apparatus.

FIG. 2 is a diagram illustrating a first perspective view of the CMP apparatus 100. The motor 180 is coupled to the guiding block 200 that is coupled to the guiding rail 190. The guiding block 200 is capable of translational motion along the guiding rail 190. In an embodiment of the invention, the guiding rail 190 includes blocks (e.g., stoppers) at the ends of the rails 190 to prevent the guiding block 200 from detaching from the rail 190 during operation. The rod 140 includes a clamping window 210 (also referred to as a slot) along the length of the rod 140. In other embodiments of the invention, the clamping window 210 is shorter than the length of the rod 140 and is centered along the length of the rod 140. The clamping window 210 has a width at least slightly larger than the width of the pad 130. For example, for a 50 mil pad, the clamping window 210 can have a width of about 65 mil. In an embodiment of the invention, the clamping window 210 can extend through both the first and second sections of the rod 140 so that the pad 130 can fit through the rod 140; to ensure that the pad 130 will be gripped when a sleeve is engaged on the small diameter end to compress the small diameter and thus compress the edges of the clamping window into the pad so as to hold the pad; and to enable the removed pad 130 to slide off the rod 140. During operation of the pad removal apparatus, an edge of the pad 130 is placed and secured into the clamping window 210. A collar mechanism can be used to secure the pad 130 to the clamping window 210 so that the pad 130 will not slip out during rotation of the rod 140. In another embodiment of the invention, other techniques are used to secure the pad 130 to the rod 140, such as using adhesives to couple the pad 130 to the rod 140 or using a perforating mechanism to perforate the pad 130 and couple the pad 130 to the rod 140 via the perforations.

Figure 3:
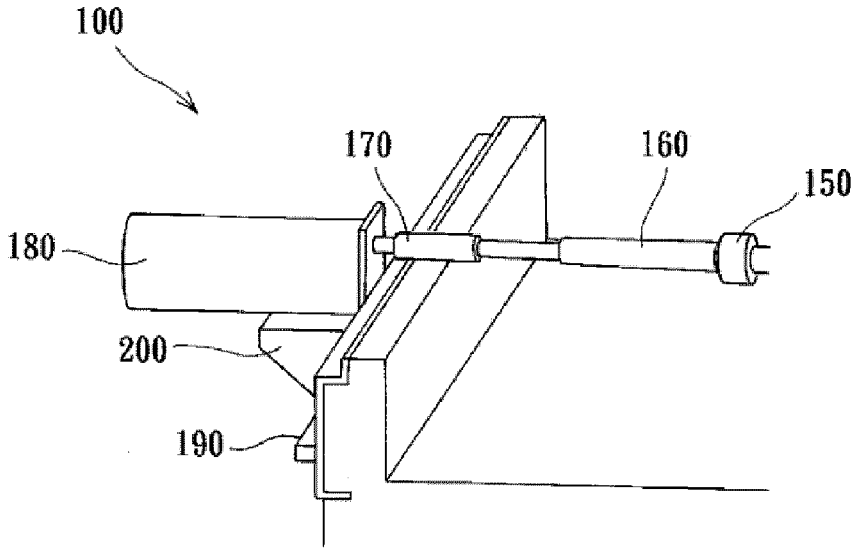
FIG. 3 is a diagram illustrating a second perspective view of the CMP apparatus.

FIG. 3 is a diagram illustrating a second perspective view of the CMP apparatus 100. The rod 140 is coupled to the motor 180 via the adapter 150 and the universal joints 160 and 170. Accordingly, when the motor 180 causes rotation of the universal joint 170, the joint 170 rotates parallel with the ledge, slides the motor 180 across the guide rail 190, thereby also sliding the rod 140 across the platen 120 as it rolls up the pad 130. In addition, resistance from rolling up the pad 130 also causes the engine motor 180 to slide across the guiding rail 190. The torque generated as rod 140 lifts the pad 130 under rotational force drives the lateral movement of the rod 140 since the motor 180 is free to move on the rail. In addition, the motor 180 can be moved horizontally by hand to ensure the prevention of the joints 160 and 170 from locking up.

Figure 4:
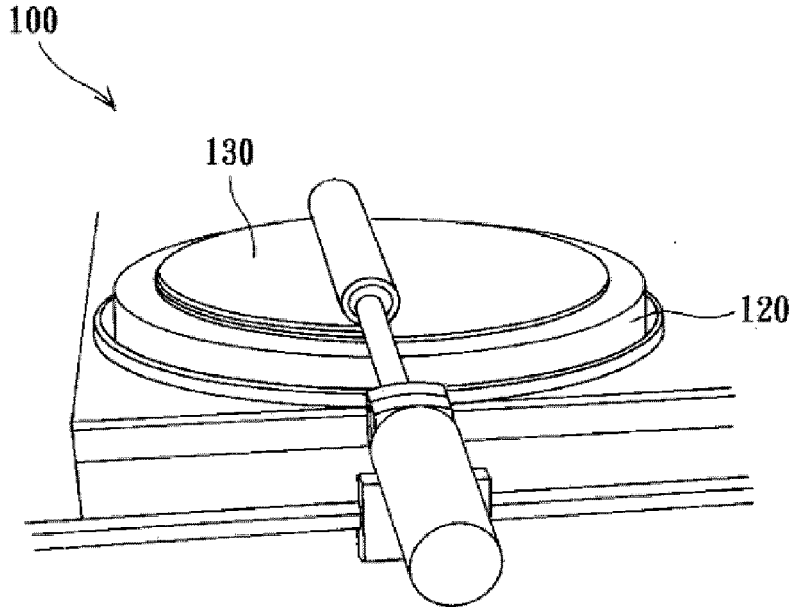
FIG. 4 is a diagram illustrating a third perspective view of the CMP apparatus.

The joints 160 and 170 accommodate the changes in the Y and Z axes as the pad 130 is lifted from the platen 120 and wraps around the rod 140 as is shown in FIG. 4. In addition, the joints enable easier insertion of the pad 130 into the clamping window 210 of the rod 140 by allowing the rod 140 to pivot with respect to the pad 130 without movement or activation of the motor 180.

Figure 5:
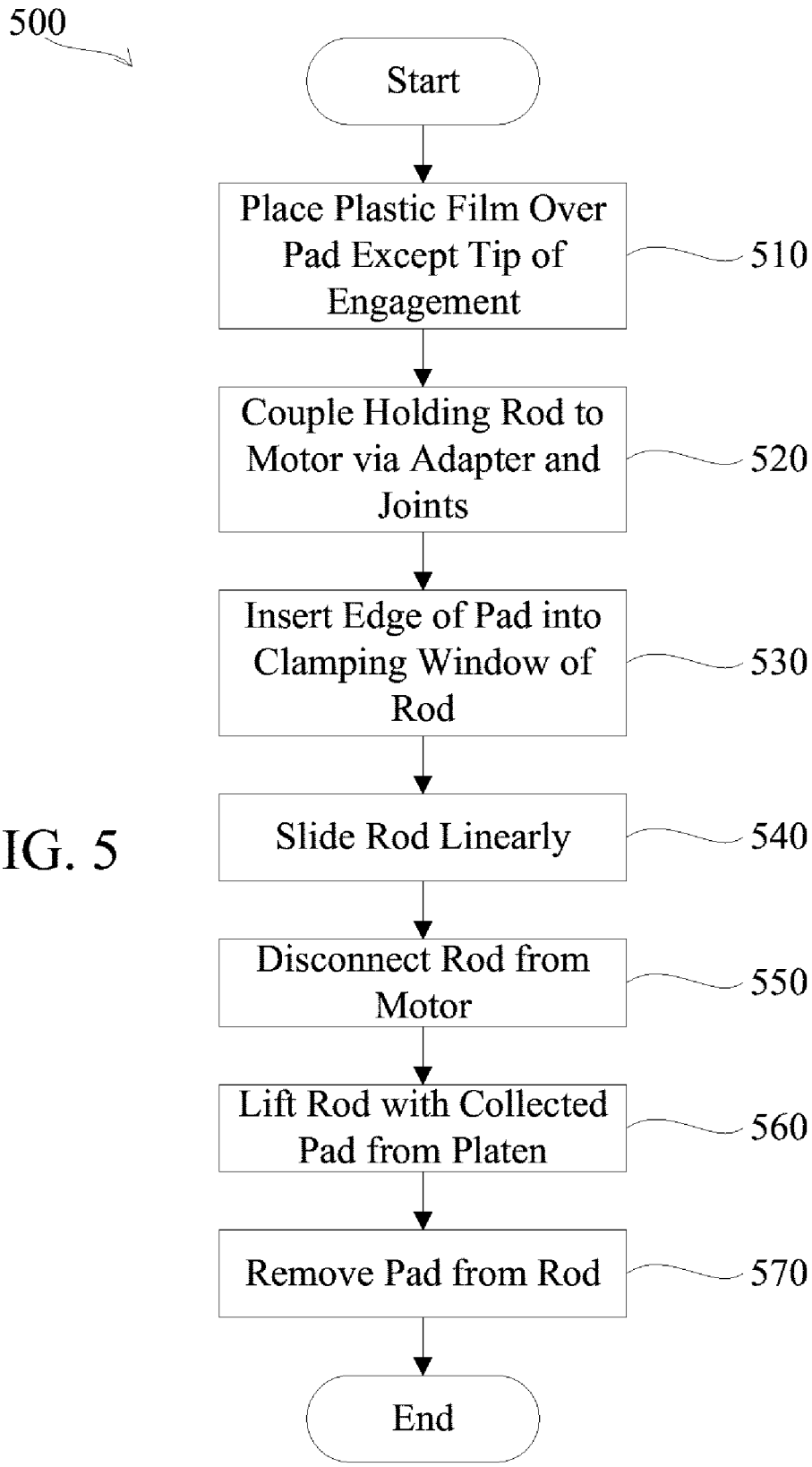
FIG. 5 is a flowchart illustrating a method of removing a pad from a platen according to an embodiment of the invention.

FIG. 5 is a flowchart illustrating a method 500 of removing a pad from a Platen according to an embodiment of the invention. First, a plastic film is placed (510) over the pad except for a tip or edge of the pad where it is to be engaged by a rod (e.g., the rod 140). The plastic ensures that the pad does not stick together when the pad is removed, thus making it easier to remove the pad from the rod. The plastic is about 0.002" thick. Next, the rod is coupled (520) to a motor (e.g., the motor 180) via an adapter (e.g., the adapter 150) and universal joints (e.g., joints 160 and 170). The edge or tip of the pad (e.g., about 1 to about 2 inches) is then inserted (530) into a clamping window of the rod. In another embodiment, the edge or tip of the pad can be coupled to the rod via other techniques, such as adhesives or perforations. The rod is then slid (540) linearly across the pad, thereby picking up, rotating and collecting the pad onto the rod. The linear and/or rotational motion can come from the motor. The rod is then disconnected (550) from the motor. The rod with the collected pad is then lifted (560) from the platen and the pad removed (570) from the rod. The method 500 then ends.

The foregoing description of the illustrated embodiments of the present invention is by way of example only, and other variations and modifications of the above-described embodiments and methods are possible in light of the foregoing teaching. For example, while the pad removal apparatus and method are illustrated for use with a CMP pad, the apparatus and method can be used with any type of pad. The embodiments described herein are not intended to be exhaustive or limiting. The present invention is limited only by the following claims.

What is claimed is:

1. A method, comprising:

coupling a CMP pad to a rod;

rotating the rod to roll up the pad; and rolling the rod laterally during the rotating, wherein the rotating is caused by a motor, and wherein a universal joint couples to the rod the motor to transfer torque and allow for a range of movement during the rotating.

2. A method, comprising:

coupling a CMP pad to a rod;

rotating the rod to roll up the pad;

rolling the rod laterally during the rotating, wherein the rolling is caused by the rotation of the rod.

3. A method, comprising:

coupling a CMP pad to a rod;

rotating the rod to roll up the pad;

rolling the rod laterally during the rotating, and placing a film over the pad except for an edge before the rotating and rolling.

4. An apparatus, comprising:

a rod capable of being coupled to a CMP pad;

a motor coupled to the rod to cause rotation of the rod; and a universal joint that couples to the rod the motor to transfer torque and allows for a range of movement during the rotation of the rod.

5. An apparatus, comprising:

a rod capable of being coupled to a CMP pad; and a motor coupled to the rod to cause rotation of the rod, wherein the rotation of the rod causes rolling of the rod.

6. An apparatus comprising:

a rod capable of being coupled to a CMP pad;

a motor coupled to the rod to cause rotation of the rod;

a guide block coupled to the motor; and a guide rail operatively associated with the guide block to guide the movement of the guide block and motor along the guide rail as the rod rotates.

7. The apparatus of claim 6, further comprising a universal joint that couples the rod to the motor to transfer rotational movement from the motor to the rod.

8. The apparatus of claim 6, wherein the rod includes a clamping window capable of clamping the CMP pad to the rod.

9. The apparatus of claim 6, wherein the motor is activated by at least 2 switches.

10. The apparatus of claim 6, wherein the motor ceases rotation when the pad is removed from a platen.

11. A method comprising:

coupling a CMP pad to a rod;

rotating the rod with a motor to remove the CMP pad from a platen; and using a guide block operatively associated with a guide rail to guide a lateral movement of the rod and motor along the guide rail as the rod rotates.

12. The apparatus of claim 11, further comprising using a universal joint to couple the rod to the motor to transfer rotational movement from the motor to the rod.

13. The method of claim 11, wherein the step of coupling the CMP pad to the rod includes clamping the pad to a clamping window of the rod.

14. The method of claim 11, further comprising switching on at least two switches to turn on the motor.

15. The method of claim 11, further comprising ceasing the rotational and lateral movement of the rod when the CMP pad is removed from the platen.

* * * * *